US007214105B1

(12) United States Patent
Trerotola

(10) Patent No.: US 7,214,105 B1
(45) Date of Patent: May 8, 2007

(54) LIGHT SOCKET HOUSING

(76) Inventor: Joseph Trerotola, Grand Brass Lamp Parts, Inc. 221 Grand St., Brooklyn, NY (US) 10013

( * ) Notice: Subject to any disclaimer, the term of this patent is extended or adjusted under 35 U.S.C. 154(b) by 0 days.

(21) Appl. No.: 11/361,409

(22) Filed: Feb. 24, 2006

Related U.S. Application Data

(60) Provisional application No. 60/656,332, filed on Feb. 25, 2005.

(51) Int. Cl.
*H01R 33/05* (2006.01)

(52) U.S. Cl. ..... 439/703

(58) Field of Classification Search ..... 439/662, 439/667, 703, 704, 906
See application file for complete search history.

(56) References Cited

U.S. PATENT DOCUMENTS

| | | | |
|---|---|---|---|
| 4,146,294 | A | 3/1979 | Kornatowski et al. |
| D256,911 | S | 9/1980 | Boyer et al. |
| 4,613,790 | A | 9/1986 | Roorda |
| D295,849 | S | 5/1988 | Borja |
| 6,162,100 | A | 12/2000 | Al-Turki |
| 6,322,380 | B1 | 11/2001 | Conroy |
| 6,979,230 | B2 | 12/2005 | Cherian |

*Primary Examiner*—Khiem Nguyen
(74) *Attorney, Agent, or Firm*—Hoglund & Pamias PSC; Roberto J. Rios

(57) ABSTRACT

A housing for a light socket is made of stamped metal. It has a tubular shell that surrounds the light socket. A cap covers the bottom of the tubular shell. A threaded ring engages the bottom of the tubular shell and holds the cap in place. The shell and cap are made of stamped metal.

12 Claims, 7 Drawing Sheets

LIGHT SOCKET HOUSING

FIELD OF THE INVENTION

The present invention relates generally to light bulb sockets and more specifically to a housing that is suitable for use with a standard light socket.

BACKGROUND

The standard light socket is a basic fixture in virtually every home and office. These are commonly used in standing floor lamps, light fixtures as well as in table-top or desk-top lamps. One popular design has a metal casing that holds the actual light socket. The metal casing consists of two parts: a shell and a cap. The shell is substantially tubular and the cap is shaped in the form of a cup that covers the bottom of the shell. The light socket is positioned inside of the shell. The cap is placed over the end. The shell and cap are crimped so that when pressed together they snap into place.

SUMMARY OF THE INVENTION

According to one aspect of the invention, a housing for a standard electric light socket has a base, a body and a ring nut. The base is formed from a pressed metal cup and a round metal nut. The metal cup has a wide top defining a rim and a narrow bottom defining a hole. The pressed metal cup defines a shoulder positioned between the wide top and the narrow bottom. A side wall of the metal cup is substantially vertical from the rim to the first shoulder, then narrows at the first shoulder to form a bevel along an outer surface of the first side wall, and then curves inward toward the narrow bottom of the metal cup. The side wall defines a first slot extending down from the rim. The round metal nut is a substantially hollow cylinder having a top and a bottom. The substantially hollow cylinder has threads through its hollow interior from the top to the bottom. A pair of flanges extend up from the top of the substantially hollow cylinder and pass through the hole in the narrow bottom of the pressed metal cup. The flanges are pressed apart to attach the round metal nut to the pressed metal cup. The body has a substantially cylindrical shape and is also formed of pressed metal. The body has a round top, a round bottom, a shoulder approximately midway between the round top and the round bottom and a band of threads proximate the round bottom. A side wall formed from a single piece of pressed metal extends from the round top to the round bottom of the body. A portion of the second side wall extending from the round top to the second shoulder is substantially vertical. The side wall widens at the second shoulder. A portion of the side wall extending from the shoulder to the band of threads is substantially vertical. The side wall widens at the band of threads so that an inner diameter of the body taken at the band of threads is greater than an outer diameter of the base taken at the rim. An inner diameter of the body taken above the band of threads and below the second shoulder is less than or equal to the outer diameter of the base taken at the rim. The body further defines a vertical slot extending from the round bottom through the band of threads and through a portion of the side wall below the shoulder. A dimple is punched inward through the band of threads. When the body is placed over the base so that the band of threads on the body substantially surround a portion of the base from the rim to the shoulder. The dimple in the body aligns with and engages the slot in the base so that the band of threads is prevented from turning around the portion of the base from the rim to the shoulder. The ring nut has a top and a bottom and a threaded interior wall extending from the top to the bottom. The top and the threaded interior wall are sized to engage the band of threads on the body. The bottom narrows so that a diameter taken across a hole defined by the bottom of the ring nut is less than a diameter taken across the rim of the base. When the ring nut engages the band of threads on the body and is tightened, the bottom of the ring nut presses upward against the shoulder of the base so that the rim of the base presses up against the portion of the side wall of the body extending from the shoulder to the band of threads.

According to further aspects of the invention, a standard socket assembly includes an insulated base, a threaded metal socket and a switch mechanism. The insulated base fits within the body below the second shoulder. The threaded metal socket fits within the body above the second shoulder. The switch mechanism extends out through the vertical slot in the body. An insulating cardboard tube is positioned between the standard socket assembly and the body.

According to another aspect of the invention, a housing especially suited for a standard light bulb socket includes a shell, a cap and a capture ring. The shell has a substantially cylindrical shape. The shell has an upper portion, a lower portion below the upper portion and a threaded portion below the lower portion. The upper portion has a first inner diameter. The lower portion has a second inner diameter larger than the first inner diameter. The treaded portion has a third inner diameter larger than the second inner diameter. The shell defines a slot extending through the threaded portion and into the lower portion. The cap has a circular band extending around its top, a cup extending down from the circular band, and a nut attached to a bottom of the cup. The circular band has a first outer diameter that is less than or equal to the third inner diameter. The cup has a second outer diameter that is less than the first outer diameter so that the circular band and cup form a shoulder as they meet. The capture ring has a threaded interior wall sized to engage the threaded portion of the shell. The capture ring has a lip extending inward at its bottom to define an aperture having a forth inner diameter larger than the second outer diameter but smaller than the first outer diameter. When the threaded interior wall of the capture ring engages the threaded portion of the shell, the aperture presses against the shoulder to secure the cap.

According to further aspects of the invention, the shell is constructed from a single sheet of stamped or pressed metal. The cup and circular band of the cap are also formed from another single sheet of pressed metal. The shell has a dimple extending inward from the threaded portion. The circular band of the cap defines a square slot extending downward from its top. The square slot engages the dimple to prevent the shell from rotating with respect to the cap. The bottom of the cup defines a round hole having a pair of nibs extending inward from opposite sides of the round hole. The nut has a substantially cylindrical body with a pair of flanges extending up from a top side of the nut. The flanges extend up through the round hole in the bottom of the cup and are positioned between the nibs on opposite sides of the round hole. The flanges are pressed apart to attach the nut to the cup and wherein the nibs prevent the cup from rotating with respect to the nut.

BRIEF DESCRIPTION OF THE DRAWINGS

FIG. 3C is an end view of the stamped shell of

DETAILED DESCRIPTION

A housing for a standard light socket is constructed from three components: a shell, a cap and a captive ring. The shell is made of stamped (or pressed) metal, preferably brass. It is substantially tubular in shape. It has a shoulder midway along its body and is sized to receive a standard light socket interior. These are commercially available from a number of manufacturers. Typically, the interior portion of a light socket is termed the light socket interior. As used herein, however, light socket and light socket interior may be used interchangeably. The shell narrows at the shoulder and the light socket is positioned within the wider portion of the shell. The shoulder prevents the light socket from sliding up through the shell. The bottom of the shell has a band of threads. The shell widens slightly at this band to form another shoulder. The cap is also made of stamped metal but includes a bottom nut that is used for mounting the housing on a threaded tube or hollow stud. The cap covers the bottom of the shell. It has a hollow cup shape that provides space for running wires that connect with the light socket. The top of the cap fits within the band of threads at the bottom of the shell. The shoulder at the top of this band prevents the cap from sliding up further into the shell. The portion of the cap that fits within the shell is wider than the rest of the cap. The captive ring is threaded on its inside and has a flange or shoulder along its bottom so that the maximum inner diameter at the bottom of the captive ring is less than the diameter across the threaded portion. This flange or shoulder at the bottom of the captive ring is used to hold the cap in place. Specifically, the threads in the captive ring engage the threads at the bottom of the shell. When tightened, the flange or shoulder at the bottom of the captive ring presses against the top, wider portion of the cap to hold it in place.

Figure 1A:
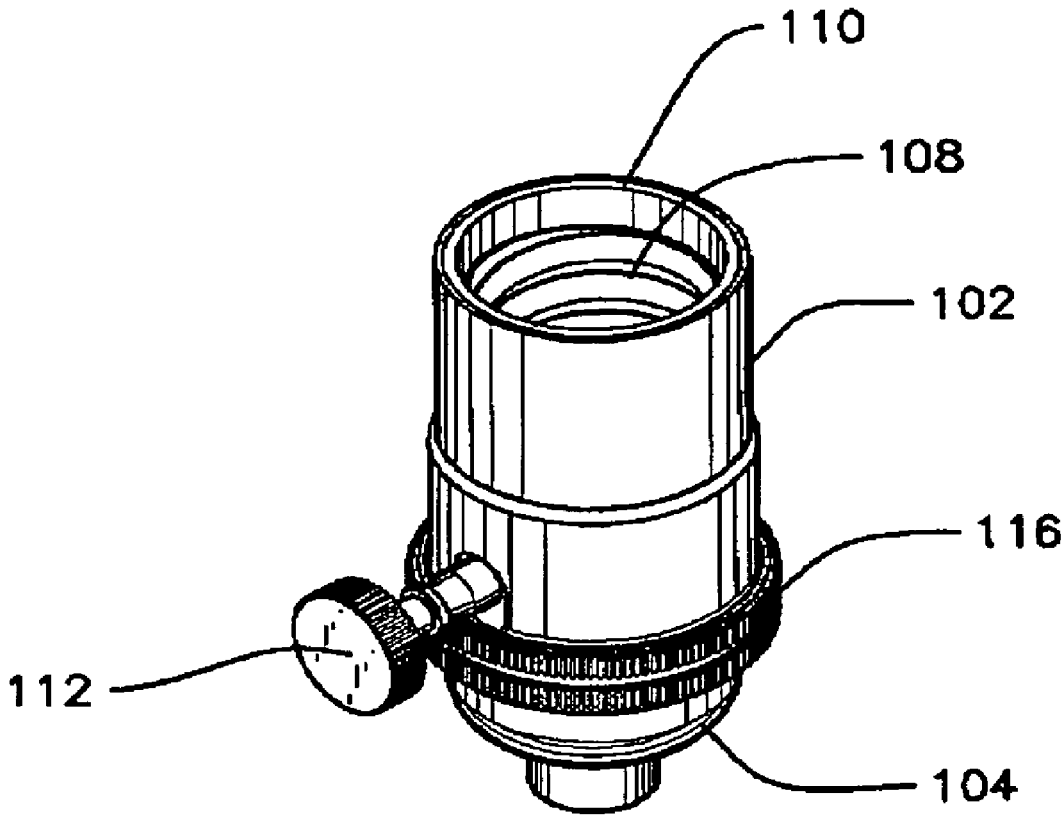
FIG. 1A is a perspective view of a light socket with a turn knob housed within a shell.

Turning to FIG. 1A, a housing is shown with a standard light socket interior (Leviton no. 7090-M). The housing includes shell 102, cap 104 and ring 106. The light socket includes standard components that are further identified below. Component parts of the light socket that are at least partially visible in FIG. 1A include a threaded metal band 108, a cardboard insulator 110 and a turn knob 112. The treaded metal band 108 receives a standard light bulb. The insulator 110 isolates the threaded metal band 108 from the outer shell 102. The insulator 110 extends well past the threaded metal band 108 and past the outer shell 102 to prevent the possibility that a user would come in contact with live electricity. The turn knob 112 is used to operate the light socket.

Figure 1B:
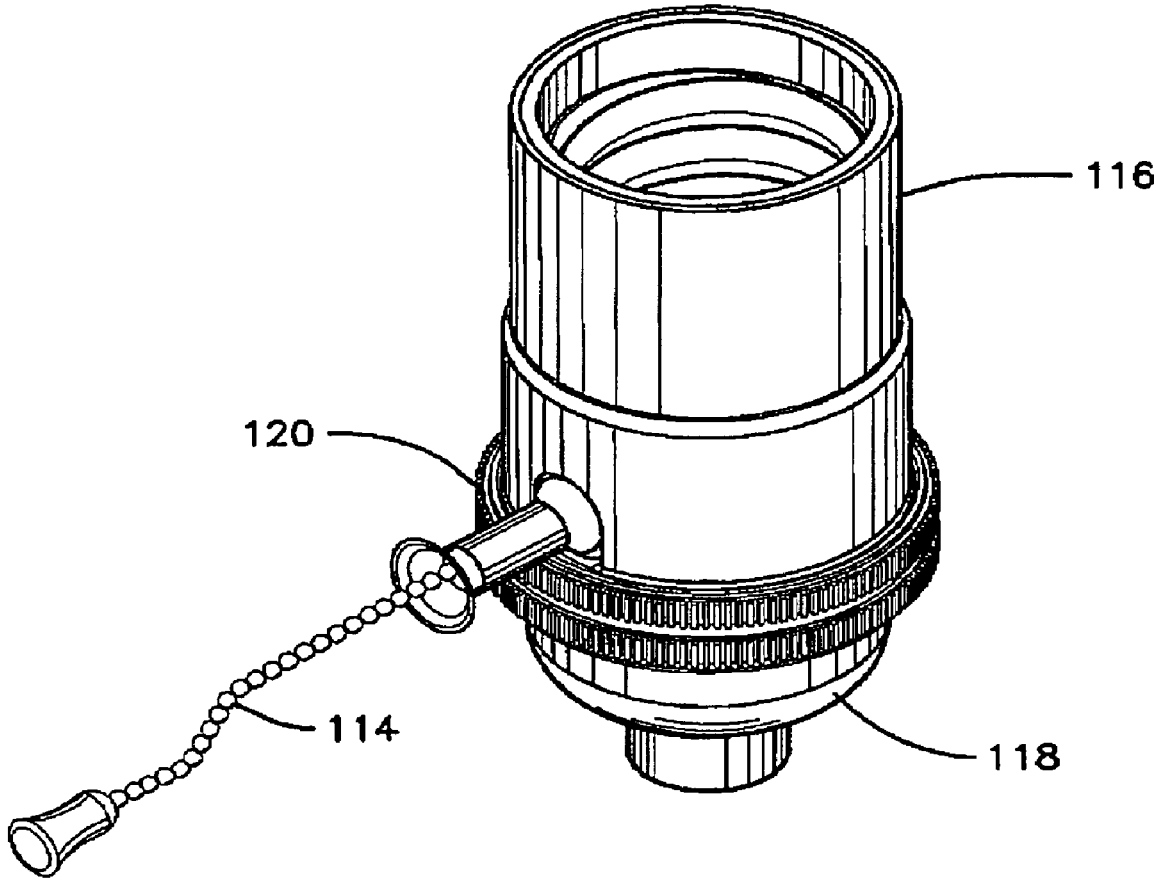
FIG. 1B is a perspective view of a light socket with a pull chain housed within a shell.

Turning to FIG. 1B, a similar housing is shown with a standard light socket interior (Leviton no. 19980-M). Unlike the socket shown in FIG. 1A, this one is operated by a pull cord 114. The housing, however, has the same component parts, including a shell 116, a cap 118 and a ring 120.

Figure 2:
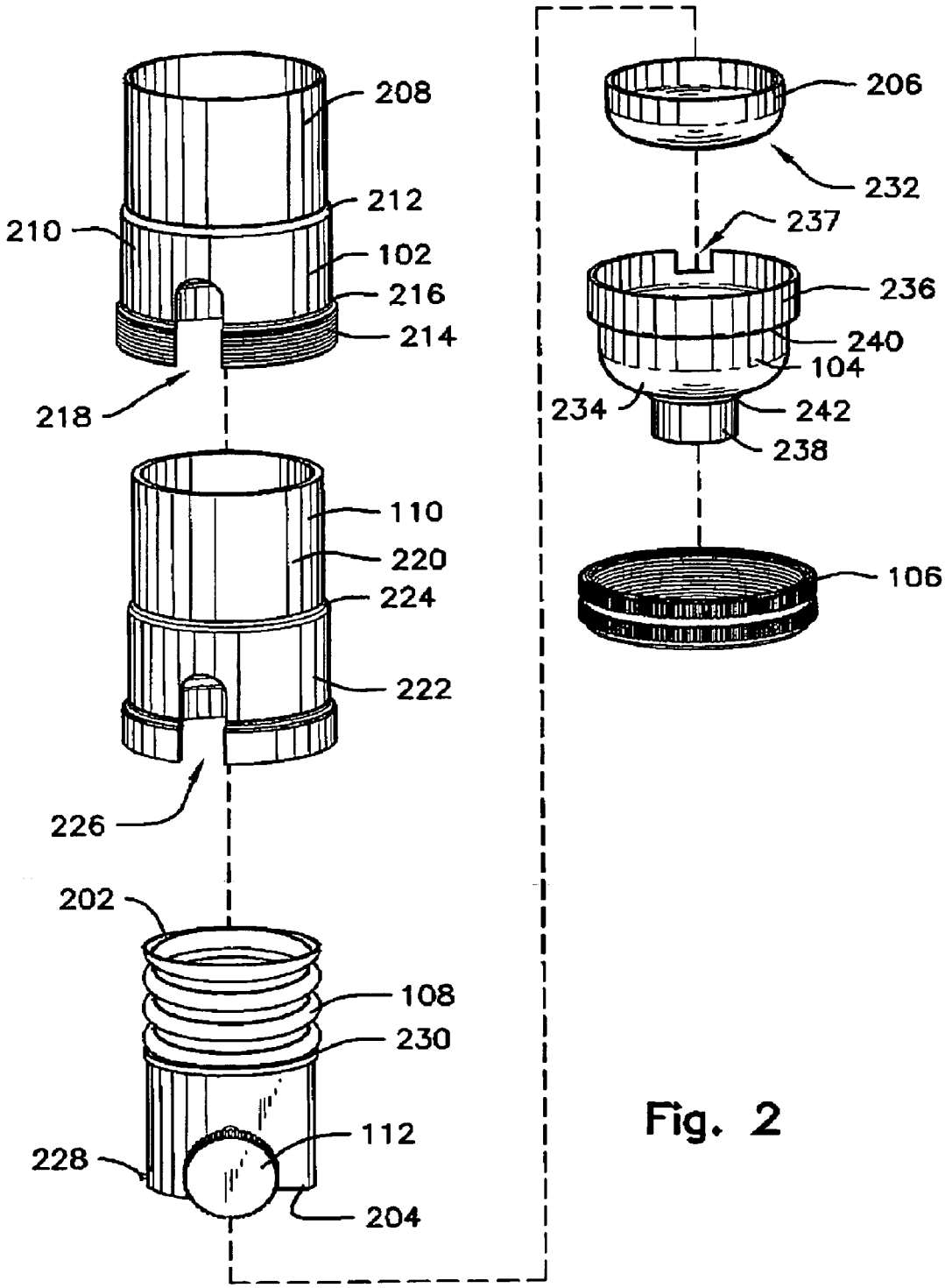
FIG. 2 is an exploded view of the light socket with the turn knob and shell of FIG. 1A.

Turning to FIG. 2, an exploded view of the housing and standard light socket of FIG. 1A are further described. Again, as shown, this includes the shell 102, cap 104 and ring 106. It also includes the cardboard insulator 110, threaded metal band 108 and knob 112. The treaded metal band 108 and knob 112 are part of a standard light socket assembly 202. These are commercially available. The light socket assembly is covered below by another cardboard insulator 206. It has a cup shape and when assembled, the insulator 206 lines the interior of cap 104. This prevents any bare wire carrying electricity through the cap 104 from coming in contact with the cap 104. These individual components are now described in further detail.

The shell 102 is constructed of stamped metal, preferably brass. It is plated or painted or otherwise finished to match a fixture. The shell 102 is substantially tubular with a round open top and bottom. It has an upper portion 208 that transitions into a lower portion 210 at shoulder 212. The upper portion 208 has an interior diameter that is slightly smaller than the lower portion 210. The shoulder 212 between these portions limits the movement of the insulator 110 and socket assembly 202 up into the shell 102. The bottom of the shell 102 defines a band of threads 214. This portion of the shell 102 joins the lower portion 210 at a shoulder 216. The inner diameter of the shell 102 at the band of threads 214 is slightly larger than at the lower portion 210. The shoulder 216 limits the movement of the cap 104 up into the shell 102. The shell 102 also defines a slot 218. This passes through the band of threads 214, past shoulder 216 and approximately midway up into the lower portion 210. It is used to pass the shaft of knob 112. On the back side of the band of threads 214, a dimple is pressed. This is not visible in this view but is shown in FIG. 3B and described below. The dimple extends inward and is used to prevent cap 104 from turning inside shell 102.

The cardboard insulator 110 is also substantially tubular in shape. It has an open top and bottom. It is divided into an upper portion 220 and a lower portion 222. These are separated by a shoulder 224. The upper portion 220 has a diameter that is just slightly smaller than that of the lower portion 222. The outer diameter of the upper portion 220 is sized to fit snugly within the inner diameter of the upper portion 208 of the shell 102. Likewise, the outer diameter of the lower portion 222 is sized to fit snugly within the inner diameter of the lower portion 210 of shell 102. The outer diameter of the lower portion 222 of insulator 110 is equal to or slightly greater than the inner diameter of upper portion 208 of shell 102. Thus, when the insulator 110 is slid inside of the shell 102, the shoulder 224 on the insulator 110 presses against the shoulder 212 on the shell 102. The insulator 110 is sized so that it completely covers the interior of the shell 102. At the top end, the insulator extends slightly beyond the shell 102 (as shown in FIG. 1A). At the bottom, insulator 110 extends even with or slightly beyond the bottom of the band of threads 214. In other words, the upper portion 220 of the insulator 110 is slightly longer than the upper portion 208 of the shell 102 and the lower portion 222 of the insulator 110 is slightly longer than the lower portion 210 of shell 102. Insulator 110 also defines a slot 226. It has approximately the same width as the slot 218 in the shell 102. It is, however, slightly longer because the lower portion 222 of insulator 110 is slightly longer than the lower portion 210 of shell 102. When the insulator 110 is positioned inside shell 102, the slot 226 is aligned with slot 218 so that they can pass the shaft of knob 112. The top end of slot 226 matches with the top end of slot 218.

The light socket assembly 202 includes the threaded metal band 108 and an insulated base 204, which houses the mechanical switching mechanism. This connects with knob 112. The insulated base 204 also includes connection points for electrical wiring. These are screw-type connections and a screw head 228 for one such connection is shown. The other connection is on the back side, opposite the knob 112. The outer diameter of band 108 is equal to or slightly less than the inner diameter of upper portion 220 of insulator 110. Band 108 fits snugly within the upper portion 220 of insulator 110. The insulated base 204, includes a lip 230 extending around its top. The lip 230 is circular and is just slightly wider than the band 108. The two are concentric. The diameter across the insulated base 204 at this lip 230 is approximately equal to or slightly smaller than the inner diameter of the lower portion 222 of insulator 110. This diameter, however, is slightly larger than the inner diameter of the upper portion 220 of insulator 110. Thus, when the light socket assembly 202 is positioned within the insulator, the lip 230 will press up against shoulder 224 and prevent the light socket assembly 202 from sliding further up into the insulator 110. The shaft of knob 112 is aligned with the slots 218 and 226. When lip 230 presses against shoulder 224, the shaft of knob 112 will just touch the top of these slots. The rest of the insulated base 204 is the same or narrower than lip 230.

Below the light socket assembly 202 is the cardboard insulator 206. It is shaped in the form of a cup with a hole 232 in its bottom. The outer diameter of insulator 206 is approximately the same as that of lip 230, so that its top edge meets the bottom of the insulated base 204 but is not large enough to fit past the insulated base. Wires connecting with the terminals on insulated base 204 pass through the hole 232. Insulator 206 is sized to fit snugly within the middle portion 234 of cap 104.

Cap 104 has a top band 236, a middle portion 234 and a bottom nut 238. Cap 104 is formed from a pressed or stamped metal, preferably brass and is finished to match shell 102. The top band 236 has a round shape. It has an inner diameter that is approximately the same as the lower portion 210 of shell 102 and has an outer diameter that fits within the inner diameter of the threaded band 214 of shell 102. When assembled, band 236 fits inside of threaded band 214 and the top rim of band 236 presses against the shoulder 216. Band 236 is just slightly wider than threaded band 214 so that it will extend just past the bottom of threaded band 214 when fully in position. The insulator 110, which extends down past the bottom of threaded band 214 fits inside of band 236. In other words, band 236 is sandwiched between the bottom of insulator 110 on the inside and threaded band 214 on the outside. Band 236 also defines a square notch 237. The square notch 237 extends from the top rim of band 236 down but not all the way to the bottom of band 236. The notch 237 is used to prevent cap 104 from turning with respect to shell 102. As mentioned above, threaded band 214 has a dimple pressed inward. This dimple is aligned with and extends through notch 237. When assembled, the dimple is contained by notch 237 so that the two pieces (shell 102 and cap 104) cannot rotate with respect to each other.

The bottom of band 236 joins the top of cup 234. The diameter of band 236 is slightly greater than the diameter of cup 234 at its top so that a shoulder 240 is formed where they join. This creates a beveled outer surface. The inner diameter at the top of cup 234 is approximately equal to or slightly less than the inner diameter of the lower portion 222 of insulator 110. Thus, when the cap 104 is positioned, the inside of shoulder 240 presses against the bottom of insulator 110 to hold it in place.

Again, the insulated cup 206 is sized to fit within cap 104. The top rim of cup 206 is flush on the inside with shoulder 240. The bottom of cup 234 defines a hole that is used to attach bottom nut 238. This attachment is further described below with reference to FIGS. 4A–4D. Bottom nut 238 is cylindrical, with a slightly widened segment at its tip forming a lip 242. Bottom nut 238 is hollow with threads on its inside. These are used to mount the assembly as part of a lamp or other fixture.

Ring 106 is the final piece in the assembly. It is open on both its top and bottom and is threaded on its inside. It is sized so that these threads engage the band of threads 214. The opening on the bottom of ring 106 is slightly narrower. It is used to capture cap 104. Specifically, the bottom of ring 106 defines an opening with a diameter that is greater than the outer diameter at the top of cup 234 but smaller than the outer diameter of band 236. Thus, when it engages the band of threads 214, it presses against shoulder 240 to hold the entire assembly together and in place.

Figure 3A:
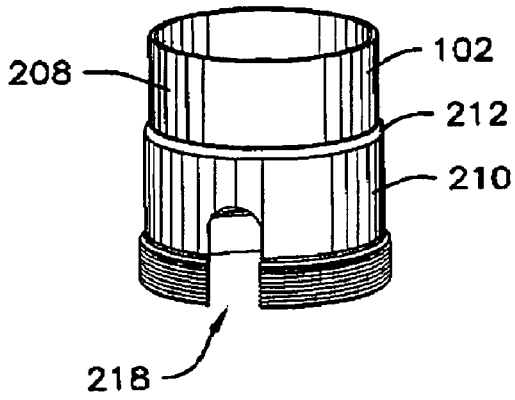
FIG. 3A is a perspective view of a front side of a stamped shell used in an assembly for housing a standard light socket.
Figure 3B:
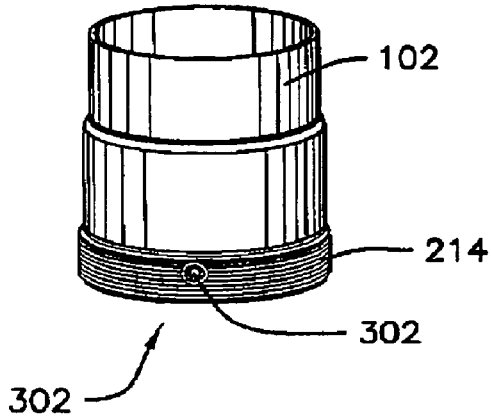
FIG. 3B is a perspective view of a back side of the stamped shell of FIG. 3A.
Figure 3C:
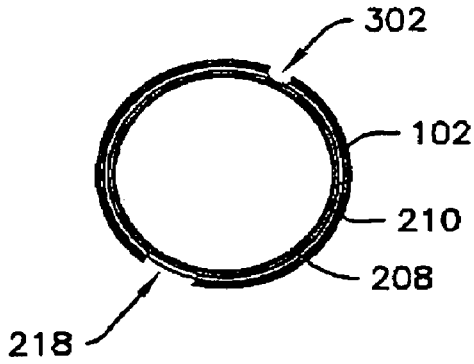

Turning to FIGS. 3A–3C, the shell 102 is further shown and described. In FIG. 3A, the shell 102 is shown from a front perspective view. Here, the slot 218 is visible. In FIG. 3B, the shell 102 is rotated 180 degrees so that the dimple 302, mentioned above, is visible in the band of threads 214. It is made by pressing a small, rectangular punch against the band of threads 214. When viewed from the bottom end of the shell 102, the dimple 302 extends inward past the inner diameter of the lower portion 210 as well as the upper portion 208.

Figure 4A:
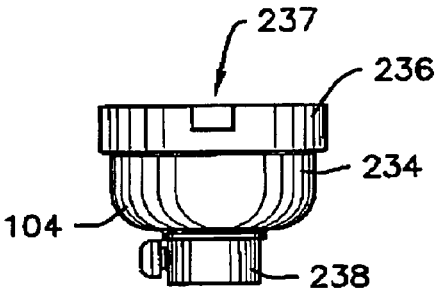
FIG. 4A is a side view of a stamped cap used in an assembly for housing a standard light socket.
Figure 4C:
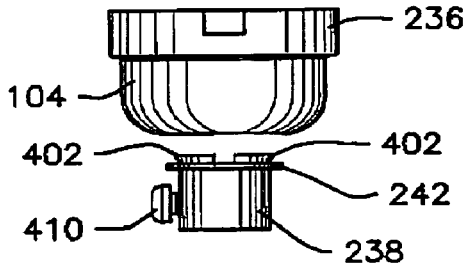
FIG. 4C is an exploded side view of the stamped cap of FIG. 4A.
Figure 4B:
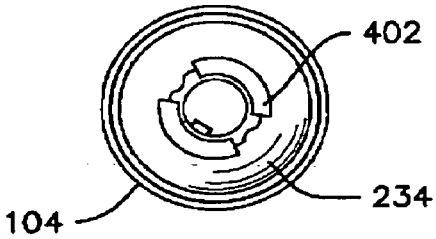
FIG. 4B is an end view of the stamped cap of FIG. 4A.
Figure 4D:
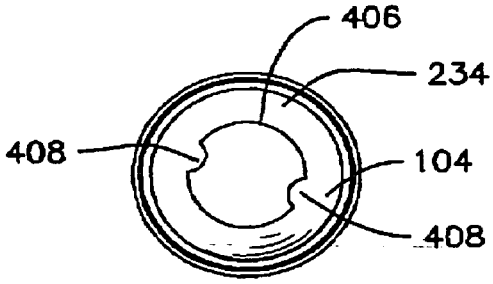
FIG. 4D is an exploded end view of the stamped cap of FIG. 4A.
Figure 4D:
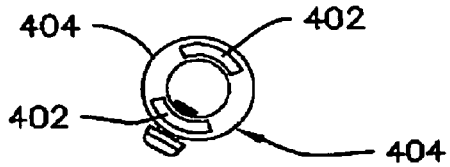

Turning to FIGS. 4A–4D, the cap 104 is further described. In FIGS. 4A and 4B, the cap 104 is shown assembled. In FIGS. 4C and 4D, the cap is shown in an exploded view.

Again, cap 104 consists of a cup 234 and band 236 formed from a single piece of pressed metal. It also has a round nut 238 that attaches to the bottom of cup 234. The band 236 defines a notch 237 that aligns with the dimple 302 in shell 102 described above.

As shown in FIG. 4C, nut 238 has a substantially cylindrical body that widens at its top to form lip 242. Lip 242 has a diameter that is wider than the hole through the bottom of cup 234. Above lip 242 a pair of semi-circular flanges 402 extend in an upward direction. As shown in FIG. 4D, the semi-circular flanges are concentric with the lip 242. They follow the rim of lip 242 but are spaced slightly inside of the outer edge of the lip 242. The semi-circular flanges 402 are separated on each side by a gap 404. When assembled, the semi-circular flanges 402 extend up through the hole in the bottom of cup 234.

More specifically, the hole 406 in the bottom of cup 234 is shown in FIG. 4D. It is round, but has a pair of nibs 408 on opposite sides extending inward. As shown in FIG. 4B, the semi-circular flanges extend up through hole 406. The nibs 408 are positioned to align with the gap between the two semi-circular flanges 402. The flanges 402 are then pressed apart to form a solid attachment with the cup 234. The nibs 408 prevent the nut 238 from turning with respect to the cup 234. The interior of nut 238 is threaded. In addition, a set screw passes 410 though the middle of nut 238. When the nut 238 engages a mounting stud, the set screw 410 is tightened to prevent the assembly from turning.

Figure 5A:
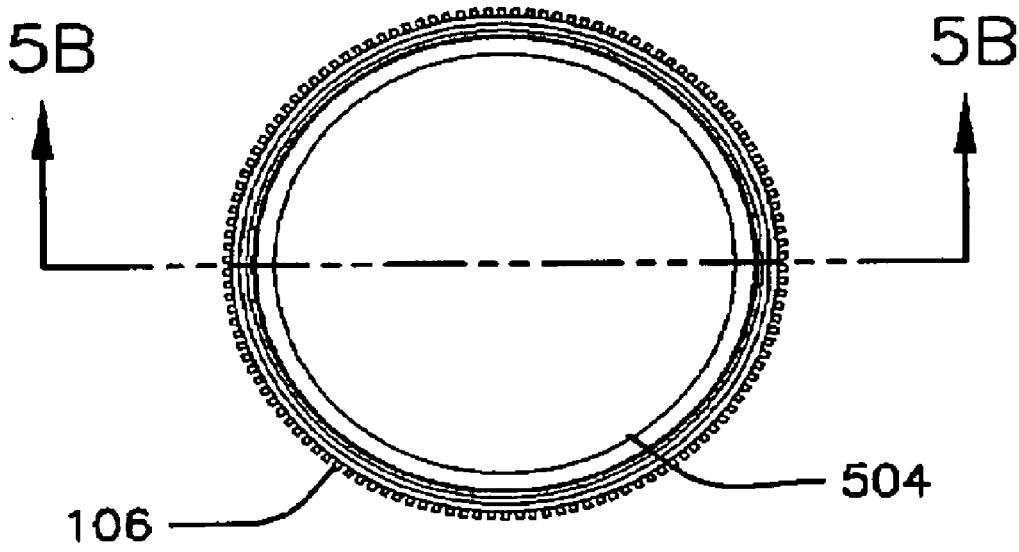
FIG. 5A is an end view of a captive ring used in an assembly for housing a standard light socket.
Figure 5B:
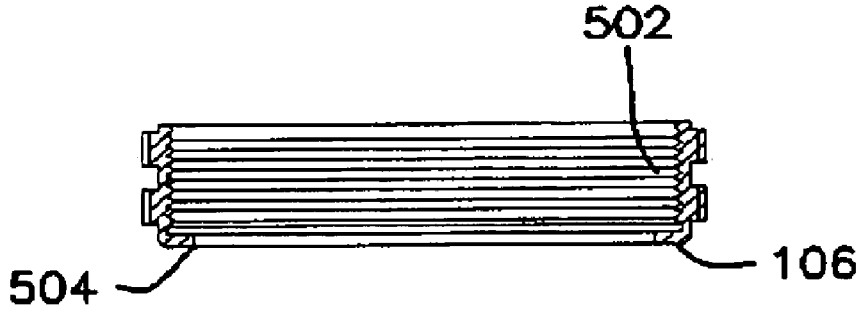
FIG. 5B is a cross-sectional side view of the captive ring of FIG. 5A, taken along section 5B—5B.

Turning to FIGS. 5A and 5B, a ring 106 is shown in further detail. FIG. 5B is a cross section taken along section 5B—5B of FIG. 5A. As shown, the interior wall 502 of ring 106 is threaded. The bottom of ring 106 defines a flange or lip 504 that extends inward. The lip 504 defines an aperture that is narrower than the rest of the interior of ring 106. As described above, this is used to engage the shoulder 240 of cap 104.

Figure 6:
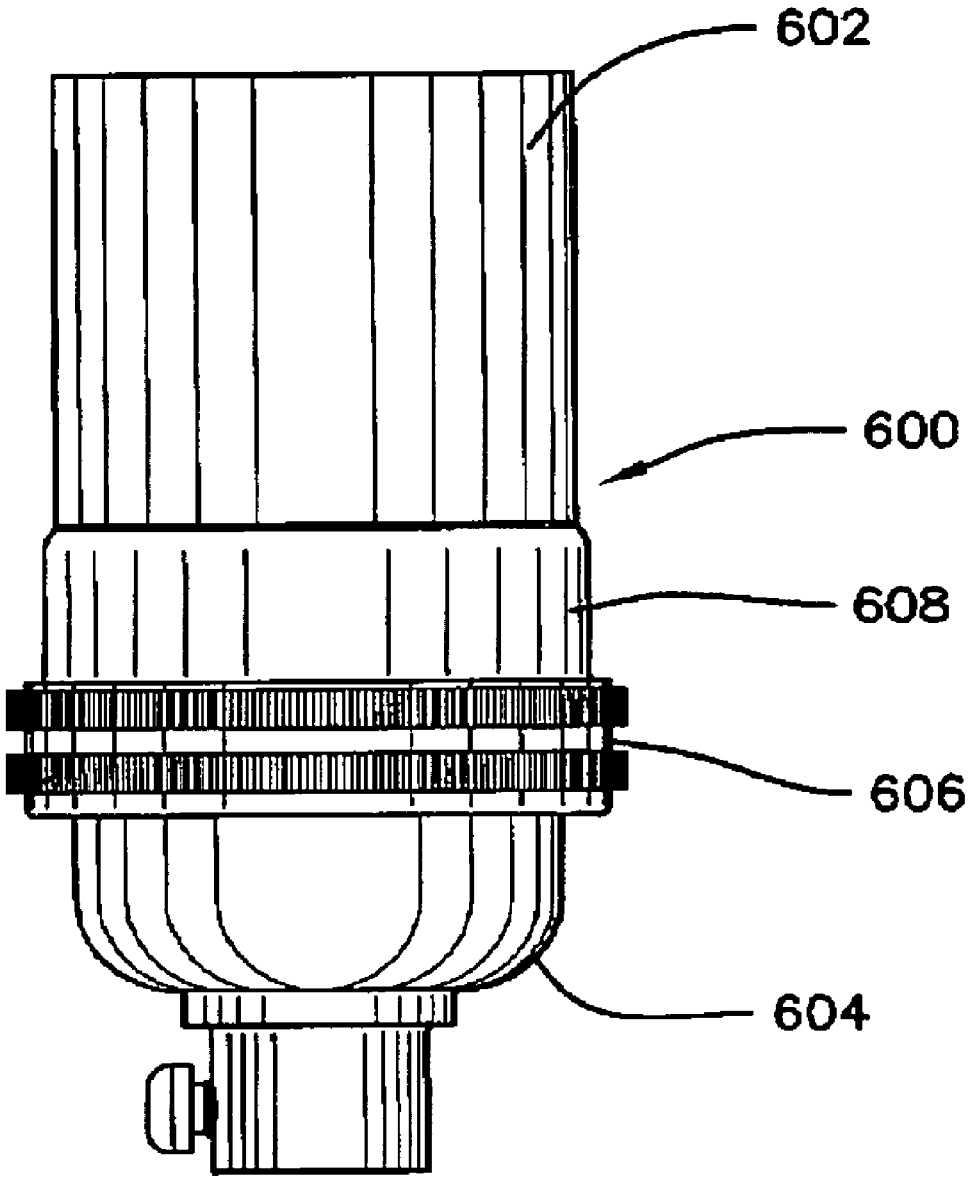
FIG. 6 is another preferred housing for a standard light socket.

Turning to FIG. 6, another shell assembly 600 is shown. It includes a shell 602, a cap 604 and a ring 606. Unlike the previously described shell assemblies, this one does not include a slot to pass a knob or pull chain (Leviton no. 9347-000). The switch must be included as part of the lamp, fixture or installed wiring. Because, the socket assembly does not include a built-in switch, it will be smaller. Accordingly, the lower portion 608 of the shell 602 is shorter. Otherwise, the shell assembly 600 is constructed as described above.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

I claim:

1. An electric lamp socket comprising:

a base formed from a pressed metal cup and a round metal nut, wherein the pressed metal cup has a wide top defining a rim and a narrow bottom defining a hole and wherein the pressed metal cup defines a first shoulder positioned between the wide top and the narrow bottom and wherein a first side wall of the metal cup is substantially vertical from the rim to the first shoulder, then narrows at the first shoulder to form a bevel along an outer surface of the first side wall, and then curves inward toward the narrow bottom of the metal cup, wherein the first side wall defines a first slot extending down from the rim, and wherein the round metal nut is a substantially hollow cylinder having a top and a bottom, wherein the substantially hollow cylinder has threads through its hollow interior from the top to the bottom, and wherein a pair of flanges extend up from the top of the substantially hollow cylinder and pass through the hole in the narrow bottom of the pressed metal cup and wherein the flanges are pressed apart to attach the round metal nut to the pressed metal cup;

a body having a substantially cylindrical shape and formed of pressed metal, wherein the body has a round top, a round bottom, a second shoulder approximately midway between the round top and the round bottom and a band of threads proximate the round bottom, and wherein a second side wall formed from a single piece of pressed metal extends from the round top to the round bottom of the body, wherein a portion of the second side wall extending from the round top to the second shoulder is substantially vertical, wherein the second side wall widens at the second shoulder, and wherein a portion of the second side wall extending from the second shoulder to the band of threads is substantially vertical, and wherein the second side wall widens at the band of threads so that an inner diameter of the body taken at the band of threads is greater than an outer diameter of the base taken at the rim and wherein an inner diameter of the body taken above the band of threads and below the second shoulder is less than or equal to the outer diameter of the base taken at the rim, wherein the body further defines a second vertical slot extending from the round bottom through the band of threads and through a portion of the second side wall below the second shoulder and wherein a dimple is punched inward through the band of threads, and wherein the body is placed over the base so that the band of threads on the body substantially surround a portion of the base from the rim to the first shoulder and wherein the dimple in the body aligns with and engages the first slot so that the band of threads is prevented from turning around the portion of the base from the rim to the first shoulder; and a ring nut having a top and a bottom and a threaded interior wall extending from the top to the bottom wherein the top and the threaded interior wall are sized to engage the band of threads on the body and wherein the bottom narrows so that a diameter taken across a hole defined by the bottom of the ring nut is less than a diameter taken across the rim of the base so that when the ring nut engages the band of threads on the body and is tightened, the bottom of the ring nut presses upward against the first shoulder and wherein the rim of the base presses up against the portion of the second side wall of the body extending from the second shoulder to the band of threads.

2. The electric lamp socket of claim 1, further comprising a standard assembly comprising an insulated base, a threaded metal socket and a switch mechanism, wherein the insulated base fits within the body below the second shoulder, the threaded metal socket fits within the body above the second shoulder and the switch mechanism extends out through the second vertical slot.

3. The electric lamp socket of claim 2, further comprising an insulating cardboard tube positioned between the standard assembly and the body.

4. The electric lamp socket of claim 3, wherein the switch mechanism comprises a turn knob or a pull chain.

5. A housing especially suited for a standard light bulb socket comprising:

a shell having a substantially cylindrical shape, wherein the shell has an upper portion, a lower portion below the upper portion and a threaded portion below the lower portion, wherein the upper portion has a first inner diameter, the lower portion has a second inner diameter larger than the first inner diameter and the treaded portion has a third inner diameter larger than the second inner diameter, and wherein the shell defines a slot extending through the threaded portion and into the lower portion;

a cap having a circular band extending around its top, a cup extending down from the circular band, and a nut attached to a bottom of the cup, wherein the circular band has a first outer diameter that is less than or equal to the third inner diameter, wherein the cup has a second outer diameter that is less than the first outer diameter so that the circular band and cup form a shoulder as they meet; and a capture ring having a threaded interior wall sized to engage the threaded portion of the shell, wherein the capture ring has a lip extending inward at its bottom to define an aperture having a forth inner diameter larger than the second outer diameter but smaller than the first outer diameter so that when the threaded interior wall of the capture ring engages the threaded portion of the shell, the aperture presses against the shoulder to secure the cap.

6. The housing of claim 5, wherein the shell is constructed from a single sheet of pressed metal and wherein the cup and circular band of the cap are formed from another single sheet of pressed metal.

7. The housing of claim 6, wherein the shell further has a dimple extending inward from the threaded portion and wherein the circular band of the cap defines a square slot extending downward from its top, and wherein the square slot engages the dimple to prevent the shell from rotating with respect to the cap.

8. The housing of claim 7, wherein the bottom of the cup defines a round hole having a pair of nibs extending inward from opposite sides of the round hole, and wherein the nut has a substantially cylindrical body with a pair of flanges extending up from a top side of the nut, wherein the flanges extend up through the round hole in the bottom of the cup and are positioned between the nibs on opposite sides of the round hole and wherein the flanges are pressed apart to attach the nut to the cup and wherein the nibs prevent the cup from rotating with respect to the nut.

9. The housing of claim 8, further comprising a standard light socket having an insulated base, a threaded metal socket extending up from the metal base and a switch mechanism extending out from the insulated base, wherein the threaded metal socket has an third outer diameter that is less than the first inner diameter, the insulated base has a fourth outer diameter that is less than the second inner diameter so that the insulated base and the threaded metal socket fit within the shell, and wherein the switch mechanism aligns with and extends through the slot defined by the shell.

10. The housing of claim 9, wherein the switch mechanism comprises a turn knob.

11. The housing of claim 9, wherein the switch mechanism comprises a pull chain.

12. The housing of claim 9, further comprising a cylindrical insulator that fits between the standard light socket and the shell.

* * * * *